US009551171B2

(12) United States Patent
Akagi

(10) Patent No.: US 9,551,171 B2
(45) Date of Patent: Jan. 24, 2017

(54) DOOR LOCKING DEVICE

(71) Applicant: U-SHIN LTD., Tokyo (JP)

(72) Inventor: Nobuya Akagi, Hiroshima (JP)

(73) Assignee: U-SHIN LTD., Tokyo (JP)

( * ) Notice: Subject to any disclaimer, the term of this patent is extended or adjusted under 35 U.S.C. 154(b) by 215 days.

(21) Appl. No.: 14/282,346

(22) Filed: May 20, 2014

(65) Prior Publication Data

US 2014/0346785 A1 Nov. 27, 2014

(30) Foreign Application Priority Data

May 21, 2013 (JP) ..... 2013-107132

(51) Int. Cl.

| | |
|---|---|
| ***E05C 3/16*** | (2006.01) |
| ***E05B 83/36*** | (2014.01) |
| *E05B 81/06* | (2014.01) |
| *E05B 81/16* | (2014.01) |

(52) U.S. Cl.

CPC ..... *E05B 83/36* (2013.01); *E05B 81/06* (2013.01); *E05B 81/16* (2013.01); *Y10S 292/23* (2013.01); *Y10T 292/1047* (2015.04); *Y10T 292/1076* (2015.04)

(58) Field of Classification Search

CPC ..... Y10S 292/23; Y10T 292/1047; Y10T 292/1076; Y10T 292/1082; E05B 77/18; E05B 77/30; E05B 81/16; E05B 81/00; E05B 81/04; E05B 83/36; E05B 81/06

USPC ..... 292/196, 201, 216, DIG. 23

See application file for complete search history.

(56) References Cited

U.S. PATENT DOCUMENTS

| | | | | |
|---|---|---|---|---|
| 2,802,683 | A * | 8/1957 | Roethel | E05B 85/28 292/280 |
| 2,955,865 | A * | 10/1960 | Leslie | E05B 85/28 292/280 |
| 6,142,540 | A * | 11/2000 | Girard | E05B 81/90 292/169.11 |
| 6,494,505 | B2 * | 12/2002 | Kobayashi | E05B 85/01 292/201 |
| 2004/0113437 | A1 * | 6/2004 | Hayakawa | E05B 81/06 292/201 |
| 2005/0082842 | A1 * | 4/2005 | Warmke | E05B 77/28 292/216 |

(Continued)

FOREIGN PATENT DOCUMENTS

| | | |
|---|---|---|
| JP | 6-73937 | 3/1994 |
| JP | 2009-203738 | 9/2009 |

*Primary Examiner* — Kristina Fulton
*Assistant Examiner* — Christine M Mills
(74) *Attorney, Agent, or Firm* — Wenderoth, Lind & Ponack, L.L.P.

(57) ABSTRACT

A door locking device includes a latch mechanism with which a striker is engageable or from which the striker is disengageable. A first link operates the latch mechanism in an interlocking manner with an inner door handle so as to release the striker. A second link is movable between an unlocked position where the second link is operated in an interlocking manner with the first link and a locked position where the second link is not operated in an interlocking manner with the first link and operates the latch mechanism in an interlocking manner with an outer handle by way of the first link in the unlocked position so as to release the striker. A locking lever changes over the second link between the unlocked position and the locked position.

6 Claims, 13 Drawing Sheets

(56) References Cited

U.S. PATENT DOCUMENTS

| | | | | |
|---|---|---|---|---|
| 2006/0267351 | A1* | 11/2006 | Spurr | E05B 81/20 292/216 |
| 2010/0072761 | A1* | 3/2010 | Tomaszewski | E05B 77/26 292/201 |

* cited by examiner

DOOR LOCKING DEVICE

BACKGROUND OF THE INVENTION

Field of the Invention

The present invention relates to a door locking device.

Description of Related Art

Conventionally, as a door locking device mounted on a door of a vehicle, there has been known a door locking device having an override function. The override function is a function of, at the time of opening the door by operating an inner door handle mounted on the door inside a vehicle, opening the door due to an operation of the inner door handle one time even when the door locking device is in a locked state.

JP-A-2009-203738 (patent literature 1) discloses a door locking device having an override function. The door locking device includes: an engaging portion by which an inner lever connected to the inner door handle operates a locking mechanism; and a link operating portion which operates a latch mechanism. By operating the inner door handle one time, a locked state of the locking mechanism is released by operating the locking mechanism and the latch mechanism thus releasing the latch mechanism.

However, in the door locking device disclosed in patent literature 1, it is necessary to sequentially operate the locking mechanism and the latch mechanism within a range of a rotational operation of the inner door handle. Accordingly, it is necessary to make a rotational range (stroke) of the inner door handle large thus giving rise to a drawback that operability is poor (the slow operation feeling).

In the door locking device disclosed in patent literature 1, to change over the locking mechanism to an unlock state from a lock state and, thereafter, to operate the latch mechanism by operating the inner door handle, the locking mechanism and the latch mechanism are required to satisfy high part accuracy and assembly accuracy thus also giving rise to a possibility that the door locking device becomes expensive.

SUMMARY OF THE INVENTION

It is an object of the present invention to provide a door locking device which exhibits excellent operability and can be manufactured at a low cost even when the door locking device has an override function.

According to an aspect of the present invention, the door locking device including a latch mechanism with which a striker is engageable or from which the striker is disengageable;

a first link which operates the latch mechanism in an interlocking manner with an inner door handle so as to release the striker;

a second link which is movable between an unlocked position where the second link is operated in an interlocking manner with the first link and a locked position where the second link is not operated in an interlocking manner with the first link, and operates the latch mechanism in an interlocking manner with an outer handle by way of the first link in the unlocked position so as to release the striker; and a locking lever which changes over the second link between the unlocked position and the locked position.

When the inner door handle is operated, the door can be opened by operating the latch mechanism using the first link regardless of whether the second link is positioned at the locked position or the unlocked position. Accordingly, it is sufficient for an operation stroke of the inner door handle to ensure a size by which the latch mechanism can be operated using the first link and hence, a rotational range can be decreased. That is, the operability of the inner door handle can be enhanced.

When the outer handle is operated in a state where the locking lever is in a locked state, the first link is not operated in an interlocking manner with the second link and hence, there is no possibility that a release operation of the latch mechanism is performed whereby the door is not opened. On the other hand, in a state where the locking lever is in an unlocked state, the first link is operated in an interlocking manner by way of the second link and hence, the door is opened.

An inner open lever to which a connection member for transmitting an operation of the inner door handle may be directly connected and which operates only the first link is provided.

The number of parts for transmitting an operating force of the inner door handle to the latch mechanism can be decreased. Accordingly, a loss of a stroke caused by the connection of the respective parts can be decreased. Further, the inner open lever operates only the first link and hence, a required operation stroke can be shortened. Further, the first link is not operated at the locked position and hence, a loss of a stroke caused by the connection of the first link and the latch mechanism can be decreased. As a result, an operation stroke of the inner door handle can be further shortened.

The latch mechanism may include:

a release lever which is operated in an interlocking manner with the first link; and a cancellation operation portion which moves the second link to the unlocked position from the locked position due to the rotation of the release lever.

It is possible not only to open the door in an interlocking manner with the release lever by operating the first link but also to move the second link to an unlocked position from a locked position by the cancel operating portion of the release lever. That is, both opening of the door and the release of a locked state can be performed simultaneously by operating only the first link with the operation of the inner door handle.

The first link and the second link may be arranged in an overlapping manner in the direction of a rotational axis of the locking lever.

A space which both links occupy can be suppressed and hence, the door locking device can be miniaturized.

The door locking device may include:

a housing body which has two planar portions formed orthogonal to each other; and a cover member which covers one planar portion of the housing body, wherein the first link is held in a reciprocally movable manner along groove portions formed on the housing body and the cover member respectively.

The first link can be held in a reciprocally movable manner by the cover member which covers a planer portion different from a planer portion on which the latch mechanism having the first link and the second link is arranged.

The door locking device may include:

the second link having an engaging portion, the first link having an operation hole in which the engaging portion is arranged, and the operation hole having a region where the engaging portion is idled even when the second link is moved in a state where the second link is positioned at a locked position, and a stepped portion with which the engaging portion is brought into contact when the second link is moved in a state where the second link is positioned at an unlocked position.

By merely forming the operation hole in the first link, a locked state or an unlocked state of the door locking device can be acquired by moving the second link to the locked position or the unlocked position.

When the inner door handle is operated in a door locked state, the door can be opened by operating only the first link. Accordingly, an operation stroke of the inner door handle can be suppressed to a value within a range more suitable for enhancing operability. Further, it is unnecessary to operate the locking mechanism (second link) before operating the latch mechanism and hence, required accuracy in parts and required accuracy in assembly are not so high and hence, the door locking device can be manufactured at a low cost.

PREFERRED EMBODIMENT

Hereinafter, an embodiment of the present invention is explained by reference to attached drawings. In the explanation made hereinafter, terms which indicate specific direction and positions (terms which include "up", "down", "side", "end", for example) are used when necessary. However, these terms are used for facilitating the understanding of the present invention by reference to drawings, and the technical scope of the present invention is not limited by meanings which these terms have. Further, the following description substantially exemplifies examples and does not intend to limit the present invention, objects to which the present invention is applied or the use of the present invention.

(1. Overall Structure)

Figure 1:
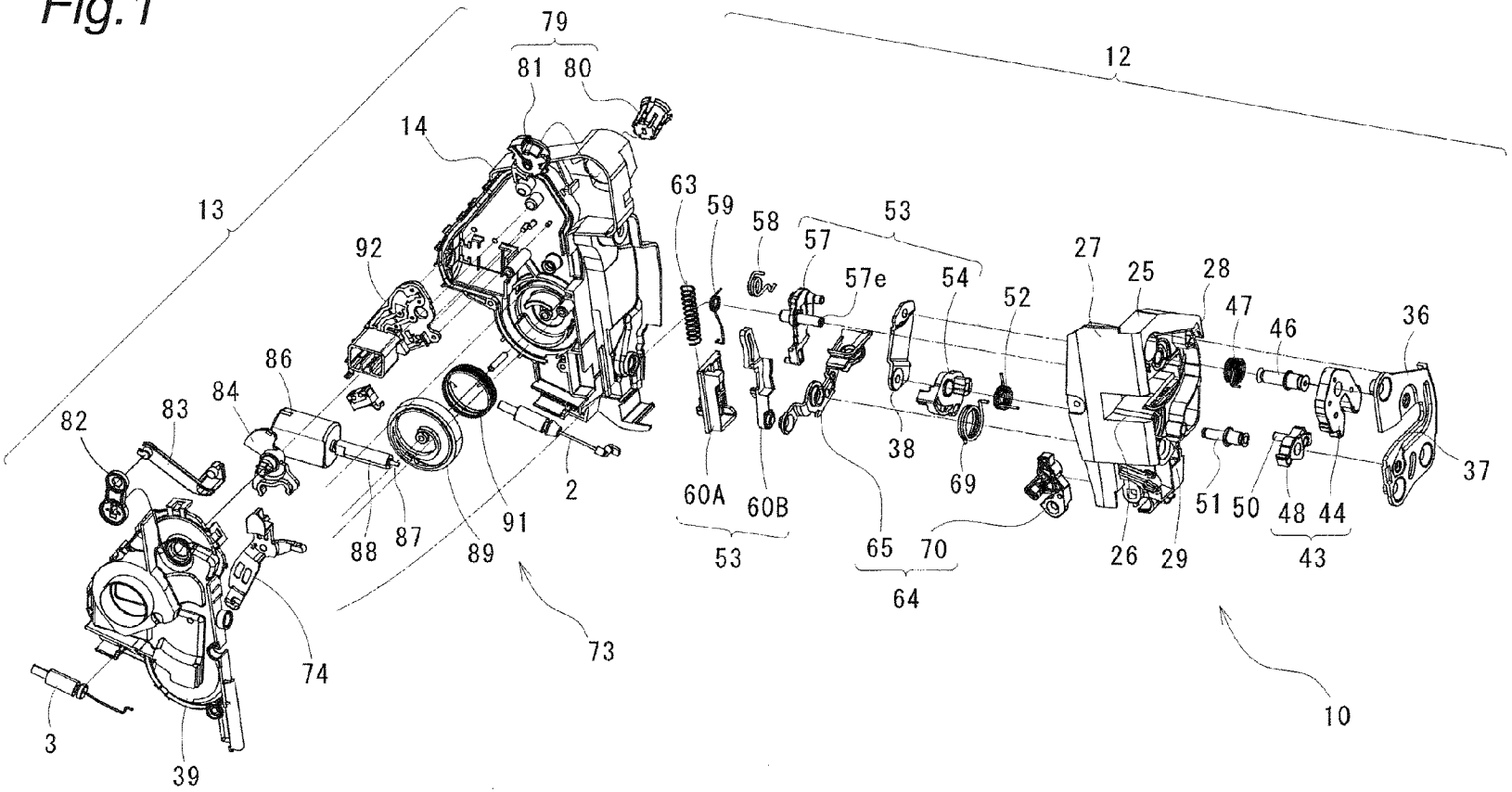
FIG. 1 is an exploded perspective view of a door locking device according to an embodiment of the present invention.
Figure 2:
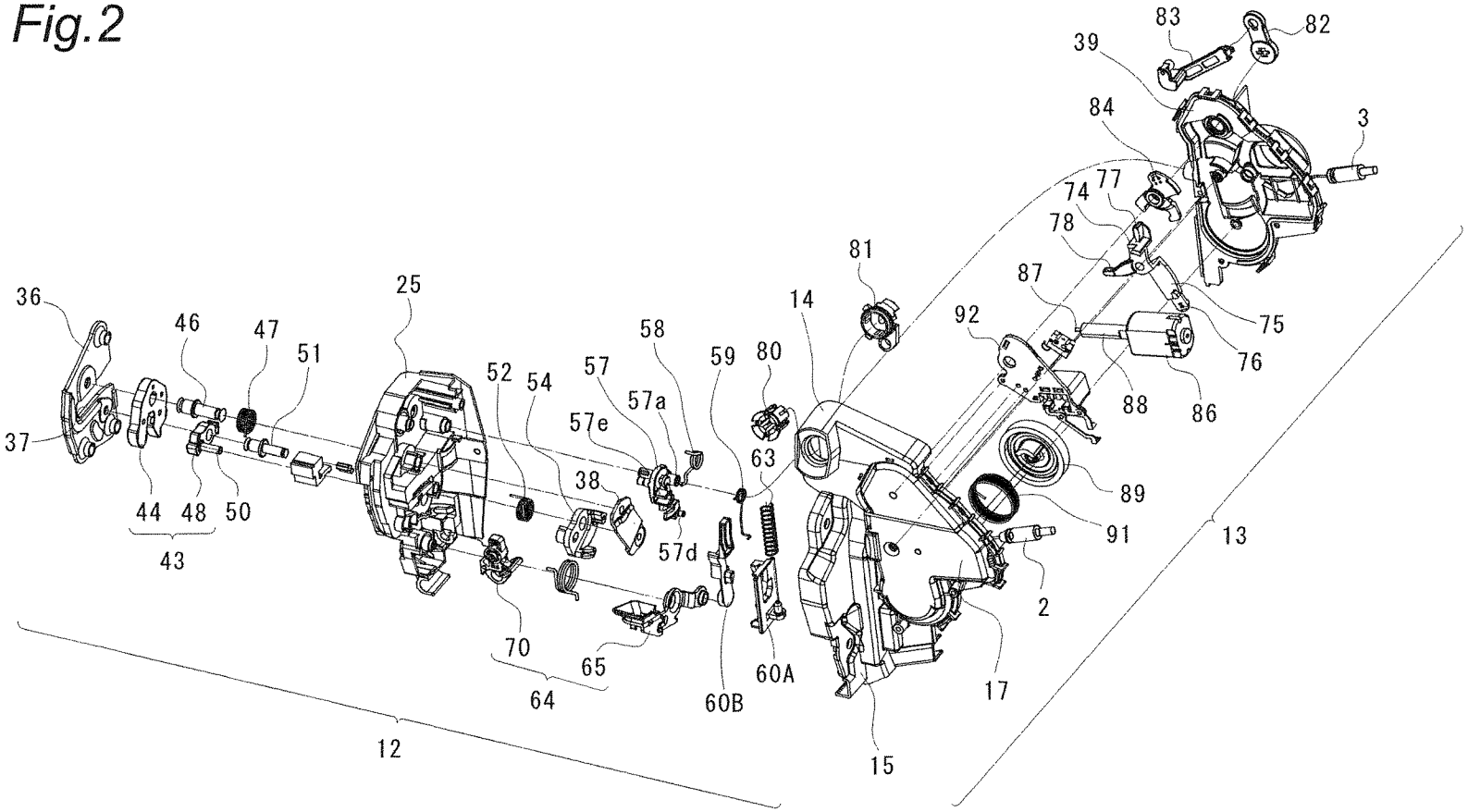
FIG. 2 is the exploded perspective view of the door locking device as viewed from a different direction.

FIG. 1 and FIG. 2 show a door locking device 10 according to this embodiment. The door locking device 10 is arranged in the inside of a door mounted on a vehicle body not shown in the drawing. In a state where the door is closed with respect to the vehicle body, the door locking device 10 brings the door into an unlocked state where the door can be opened and a locked state where the door cannot be opened. The door locking device 10 is configured such that a latch mechanism 43, a locking mechanism 53 and a releasing mechanism 64 are arranged in a first housing portion 12 in the inside of a housing 11, and a switching mechanism 73 is arranged in a second housing portion 13 in the inside of the housing 11.

(1-1. Housing)

Figure 3:
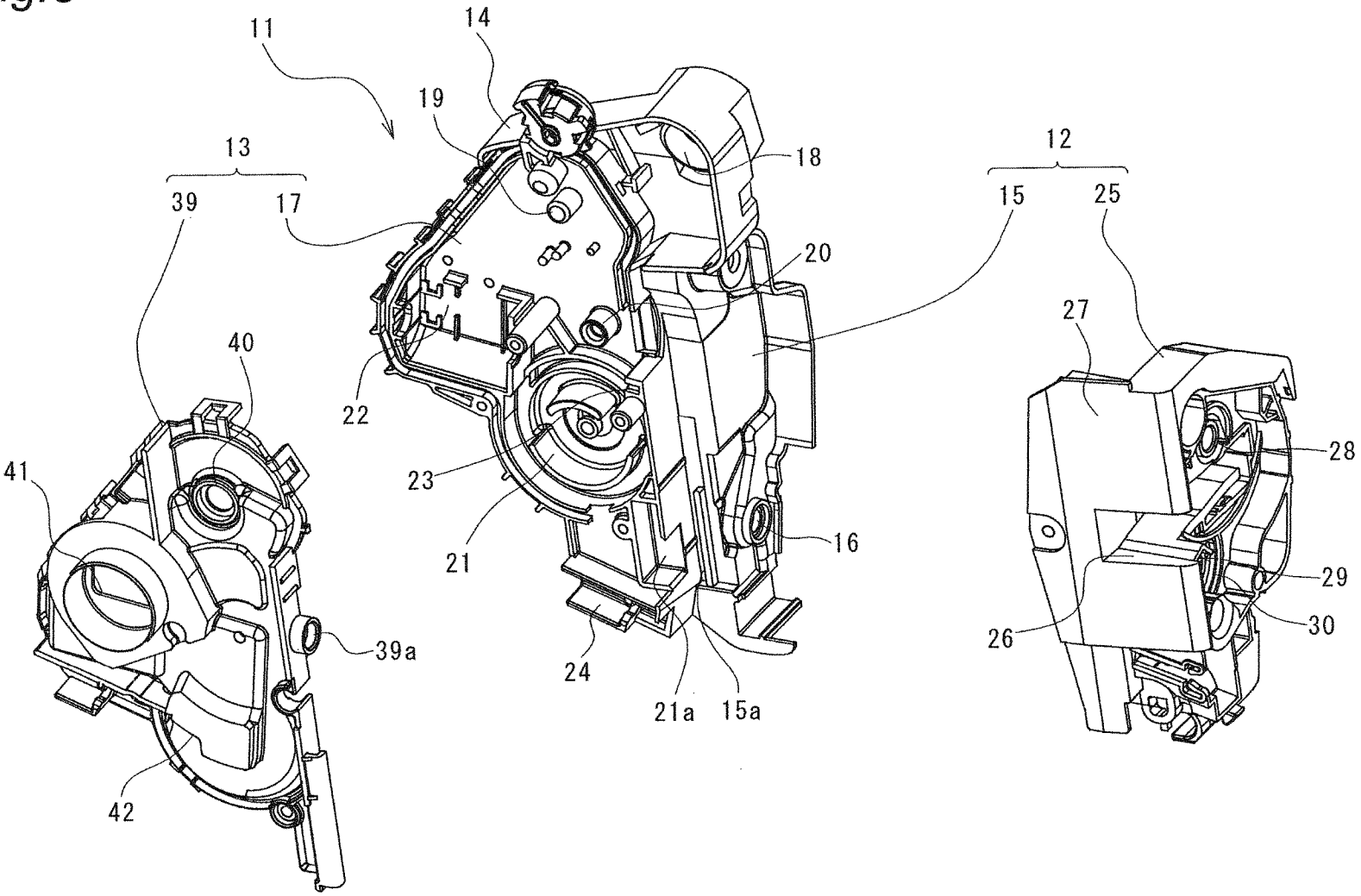
FIG. 3 is an exploded perspective view of a housing.

As shown in FIG. 3, the housing 11 is made of a synthetic resin material, and is formed of a housing body 14, and a fence block 25 and a cover member 39 which are mounted on the housing body 14.

(1-1-1. Housing Body)

The housing body 14 is formed of two planar portions each of which has an outer edge thereof surrounded by a side portion and which are arranged orthogonal to each other, that is, a first arrangement portion 15 and a second arrangement portion 17.

The fence block 25 is mounted on the first arrangement portion 15, and the first housing portion 12 is formed as an inner space. The first housing portion 12 extends along an outer (free) end surface of the door which is connected to the vehicle body by a hinge. A holding hole 16 is formed in a lower portion of the first arrangement portion 15. As described later, a distal end portion of a first pivotal support portion 33 of the fence block 25 is held in the holding hole 16. A guide groove 15*a* which extends in the vertical direction is formed on a side edge of the first arrangement portion 15.

The cover member 39 is mounted on the second arrangement portion 17, and the second housing portion 13 is formed as an inner space. The second housing portion 13 extends in the direction which intersects with the first housing portion 12 (orthogonal direction). A key rotor arrangement hole 18 and a key lever support shaft portion 19 are formed on an upper portion of the second arrangement portion 17. A switching lever supporting portion 20 is formed on the second arrangement portion 17 below the key lever support shaft portion 19. A wheel gear arrangement portion 21 is formed on the second arrangement portion 17 below the switching lever supporting portion 20. A motor arrangement portion 22 is formed on the second arrangement portion 17 on a side of the switching lever supporting portion 20. A holding groove portion 23 is formed on an upper portion of the wheel gear arrangement portion 21. The holding groove portion 23 holds a distal end of an output shaft 87 described later. A spring housing portion 21*a* is formed on the second arrangement portion 17 on a side of the wheel gear arrangement portion 21. A coil spring 63 described later is arranged in the spring housing portion 21*a*. A cable arrangement portion 24 is formed on the second arrangement portion 17 below the wheel gear arrangement portion 21. A connection cable 2 (see FIG. 1) connected to an inner door handle (not shown in the drawing) arranged on the vehicle inner side of the door is arranged at the cable arrangement portion 24.

(1-1-2. Fence Block)

Figure 5:
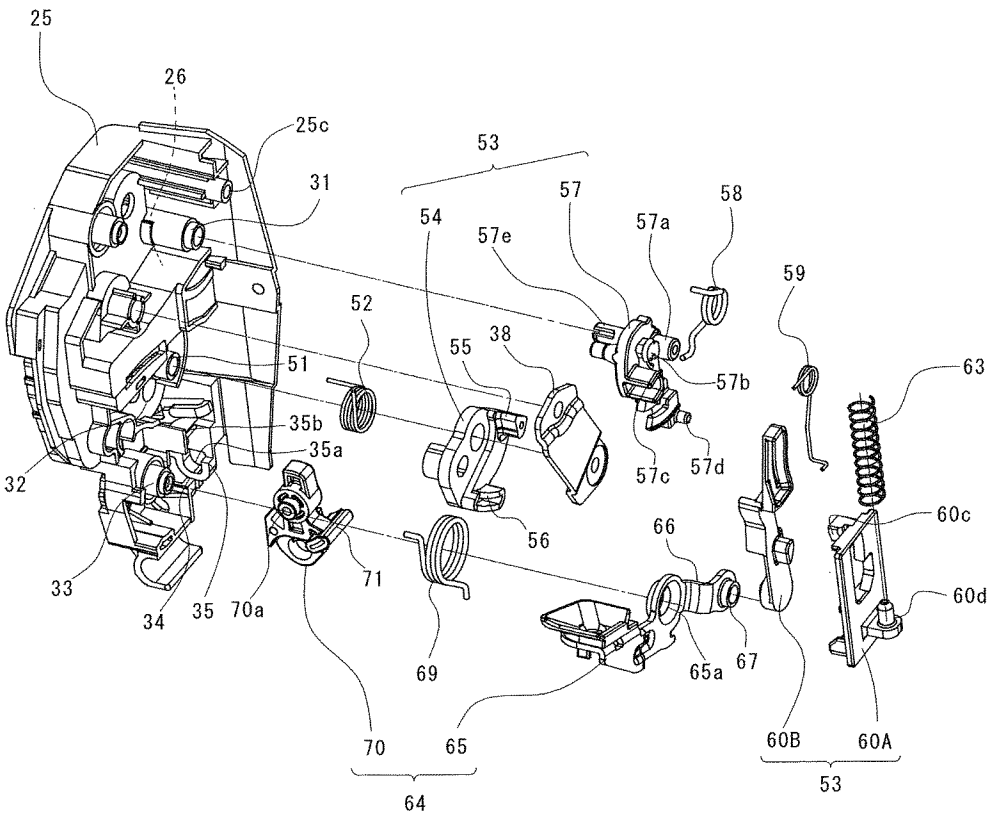
FIG. 5 is a partially enlarged view of FIG. 2.

The latch mechanism 43 is arranged on an outer surface side of the fence block 25 (an outer end surface side of the door), and the locking mechanism 53 and the releasing mechanism 64 are arranged on an inner surface side of the fence block 25 (see FIG. 1). An insertion groove 26 is formed on a center portion of an outer surface of the fence block 25. A striker 1 fixed to the vehicle body is insertable into the insertion groove 26. An outer wall portion 27 is formed on one side portion of the fence block 25. One end side of the insertion groove 26 opens on the outer wall portion 27. A fork arrangement portion 28 having a through hole is formed on the outer surface side of the fence block 25 above the insertion groove 26. A claw lever arrangement portion 29 having a through hole is formed on an outer surface side of the fence block 25 below the insertion groove 26. A connecting insertion groove 30 is formed on the claw lever arrangement portion 29. The connecting insertion groove 30 is used for making a claw lever 48 of the latch mechanism 43 and a release lever 54 of the locking mechanism 53 interlocked to each other. As shown in FIG. 5, a locking lever support shaft portion 31 and a spring receiving portion 25*c* are formed on an inner surface side of the fence block 25 above the insertion groove 26. A release lever arrangement portion 32 positioned on a back surface of the claw lever arrangement portion 29 is formed on the inner surface side of the fence block 25 below the insertion groove 26. A first pivotal support portion 33 having a distal end thereof inserted into and held by the holding hole 16 is formed on the inner surface side of the fence block 25 below the release lever arrangement portion 32. An outer open lever 65 of the releasing mechanism 64 is rotatably mounted on the first pivotal support portion 33. A second pivotal support portion 34 having an axis thereof arranged orthogonal to an axis of the first pivotal support portion 33 is formed on the inner surface side of the fence block 25 on a side of the first pivotal support portion 33. The second pivotal support portion 34 is formed of a pair of holding portions 35 (only one holding portion on one side being shown in FIG. 5) having a U-shaped bearing groove 35*a*. A restricting wall 35*b* is formed on an inner surface side of the fence block 25 above the second pivotal support portion 34, wherein the restricting wall 35*b* is brought into contact with the inner open lever 70 and prevents the removal of an inner open lever 70 from the second pivotal support portion 34. The restricting wall 35*b* has an approximately quarter cylindrical shape about the axis of the second pivotal support portion 34.

As shown in FIG. 1 and FIG. 2, a metal-made base plate 36 is arranged on the outer surface side of the fence block 25, and a metal-made set plate 38 is arranged on the inner surface side of the fence block 25. An entrance groove 37 which allows a striker 1 to pass through is formed on the base plate 36 at a position corresponding to the insertion groove 26. The set plate 38 has a plate shape and extends to the through hole of the claw lever arrangement portion 29 (shaft member 51) from the through hole of the fork arrangement portion 28 (shaft member 46). A fork 44, the claw lever 48 and the release lever 54 are rotatably supported between the base plate 36 and the set plate 38.

(1-1-3. Cover Member)

As shown in FIG. 3, the cover member 39 is formed so as to cover the key lever support shaft portion 19, the switching lever supporting portion 20, the wheel gear arrangement portion 21, and the motor arrangement portion 22 in the second arrangement portion 17 of the housing body 14 except for the key rotor arrangement hole 18. A key inputting lever arrangement portion 40 having a through hole is formed on the cover member 39 on an axis of the key lever support shaft portion 19. A connector arrangement portion 41 is formed on the cover member 39 below the key inputting lever arrangement portion 40 such that the connector arrangement portion 41 is positioned above the insertion groove 26 of the first housing portion 12. A communicating portion 42 for connecting a connection cable 3 connected to a locking knob (not shown in the drawing) arranged on the vehicle inner side of the door and a switching lever 74 of the switching mechanism 73 to each other is formed on the cover member 39 below the connector arrangement portion 41. A cylindrical bearing portion 39*a* is formed on a side surface of the cover member 39 so that a rotary shaft of a locking lever 57 described later is rotatably supported. A guide groove (not shown in the drawing) is formed on the cover member 39. The guide groove faces the guide groove 15*a* formed on the first arrangement portion 15 when the cover member 39 is mounted on the second arrangement portion 17 of the housing body 14. Both guide grooves hold a first link 60A in a vertically slidable manner.

(1-2. Latch Mechanism)

Figure 6:
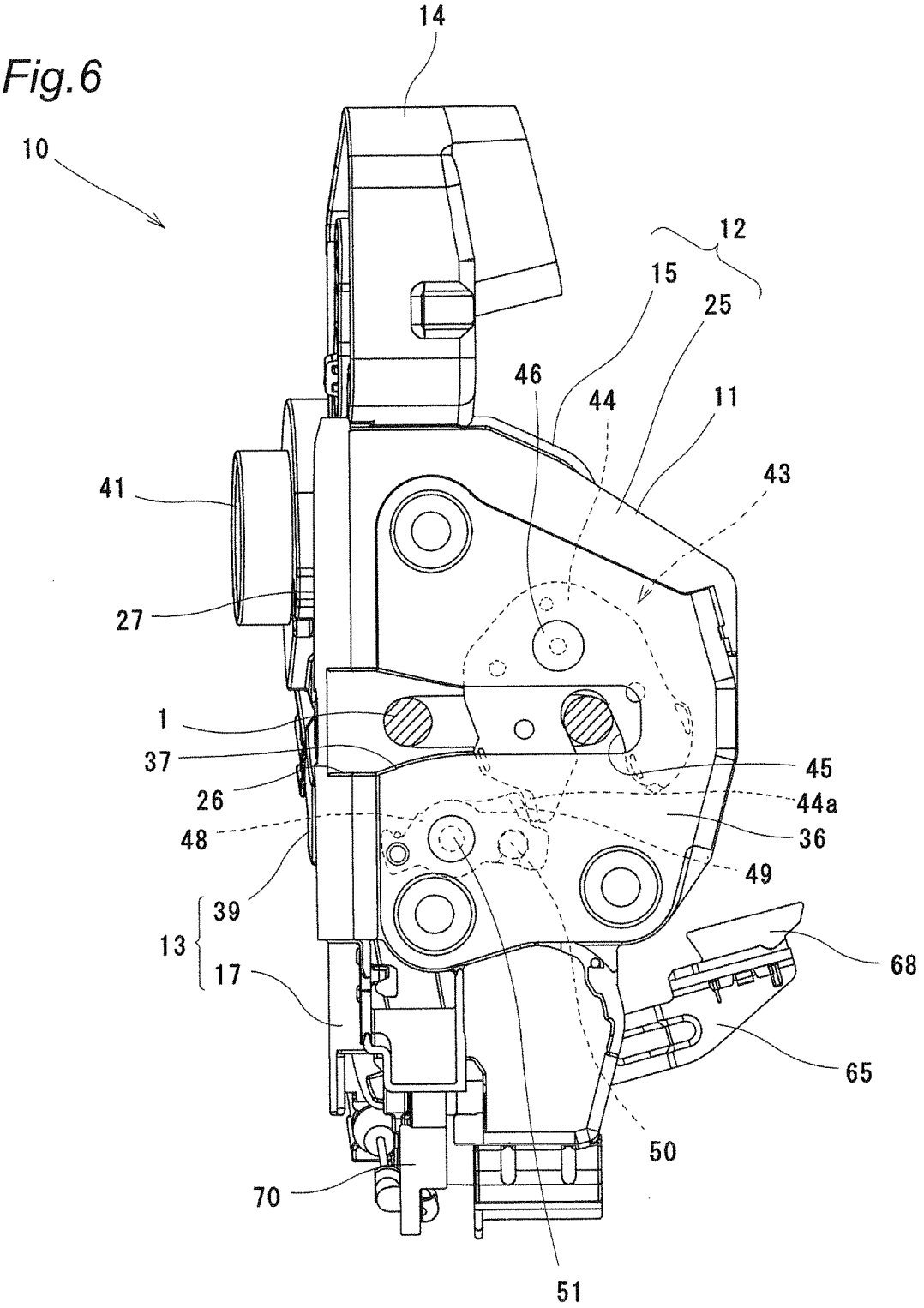
FIG. 6 is a front view of a first housing portion.

As shown in FIG. 1 and FIG. 6, the latch mechanism 43 includes the fork 44 and the claw lever 48 which are arranged on the outer surface side of the fence block 25.

(1-2-1. Fork)

The fork 44 is mounted on the fork arrangement portion 28 of the fence block 25 such that the fork 44 is rotatable about the shaft member 46 between an engaging position shown in FIG. 6 and a release position which the fork 44 reaches after being rotated in the clockwise direction from the engaging position. An engaging groove 45 which the striker 1 engages with and removed from is formed on the fork 44. An engaging receiving portion 44*a* with which an engaging portion 49 of a claw lever 48 described later engages is formed on an outer edge of the fork 44. The shaft member 46 has both ends thereof fastened and fixed to the base plate 36 and the set plate 38 respectively, and a spring 47 (FIG. 1) is mounted on an outer periphery of the shaft member 46. Due to such a structure, the fork 44 is biased toward the release position from the engaging position.

(1-2-2. Claw Lever)

The claw lever 48 includes an engaging portion 49 which engages with the fork 44 so as to restrict the rotation of the fork 44. The claw lever 48 is mounted on the claw lever arrangement portion 29 of the fence block 25 such that the claw lever 48 is rotatable about the shaft member 51 between an engaging position shown in FIG. 6 and a non-engaging position which the claw lever 48 reaches after rotating in the clockwise direction from the engaging position. A connecting shaft portion 50 which projects toward an inner surface side through the connecting insertion groove 30 of the fence block 25 is formed on the claw lever 48. The shaft member 51 penetrates the claw lever 48 and the fence block 25, and both ends of the shaft member 51 are fastened and fixed to the base plate 36 and the set plate 38 respectively. A spring 52 is mounted on the shaft member 51 so as to bias the claw lever 48 to a position where the claw lever 48 and the fork 44 engage with other.

(1-3. Locking Mechanism)

As shown in FIG. 5, the locking mechanism 53 includes: the release lever 54; the locking lever 57; the first link 60A; and a second link 60B, and is arranged on an inner surface side of the fence block 25.

(1-3-1. Release Lever)

As shown in FIG. 5, the release lever 54 is arranged on the release lever arrangement portion 32 of the fence block 25, and is rotatably supported about the shaft member 51. A connecting shaft portion 50 of the claw lever 48 engages with the release lever 54, and the release lever 54 is rotated integrally with the claw lever 48 positioned on an opposite side of the fence block 25. An operation receiving portion 55 is formed on one side of one surface of the release lever 54, and a cancellation operation portion 56 is formed on the other side of one surface of the release lever 54. The operation receiving portion 55 is pushed by an operating portion 60*c* of the first link 60A. Due to such a structure, the release lever 54 is rotated together with the claw lever 48. The cancellation operation portion 56 pushes a side edge of the second link 60B due to the rotation of the release lever 54. Accordingly, the second link 60B moves to an unlocked position from a locked position.

(1-3-2. Locking Lever)

A spring receiving shaft 57*a*, a spring receiving portion 57*b*, a connecting frame portion 57*c*, and a guide projecting portion 57*d* are formed on one surface of the locking lever 57 in this order from the top. A winding portion 59*a* of an engaging spring 59 is mounted on the spring receiving shaft 57*a*. One end 59*b* of the engaging spring 59 is fixed to the locking lever 57. The other end 59*c* of the engaging spring 59 is positioned in an elongated hole 62*a* formed in the second link 60B described later, and guides the second link 60B in a movable manner in the vertical direction. One end of a biasing spring 58 is brought into contact with the spring receiving portion 57*b*. A winding portion of the biasing spring 58 is mounted on the spring receiving portion 25*c* of the fence block 25, and the other end of the biasing spring 58 engages with an engaging receiving portion (not shown in the drawing) of the fence block 25. A portion of the spring receiving portion 57*b* of the locking lever 57 with which one end of the biasing spring 58 is brought into contact has a chevron shape (not shown in the drawing). Due to such a structure, the locking lever 57 is biased to an unlocked position side shown in FIG. 11 as well as to a locked position side shown in FIG. 12 respectively about a rotary shaft 57*e* (locking lever support shaft portion 31) described later. A switching operation portion 78 of the switching lever 74 described later is connected to the connecting frame portion 57*c*. The guide projecting portion 57*d* is arranged such that the guide projecting portion 57*d* can push a guide surface 62*b* of the second link 60B described later. Due to such a structure, the locking lever 57 and the second link 60B are operated in an interlocking manner so as to move (swing) the second link 60B.

The connecting shaft 57*e* which is arranged coaxially with the spring receiving shaft 57*a* is formed on the other surface (a fence block 25 side surface) of the locking lever 57. The connecting shaft 57*e* is mounted on the locking lever support shaft portion 31 of the fence block 25. Due to such a structure, the locking lever 57 is supported on the locking lever support shaft portion 31 in a rotatable manner about the locking lever support shaft portion 31.

(1-3-3. First Link)

The first link 60A is held between a guide groove 15*a* formed on the first arrangement portion 15 of the housing body 14 and a guide groove (not shown in the drawing) formed on the cover member 39 such that the first link 60A is movable in the vertical direction within a range defined by these guide grooves. The first link 60A is arranged on the fence block 25 such that the first link 60A overlaps with the release lever 54 and the second link 60B.

Figure 9:
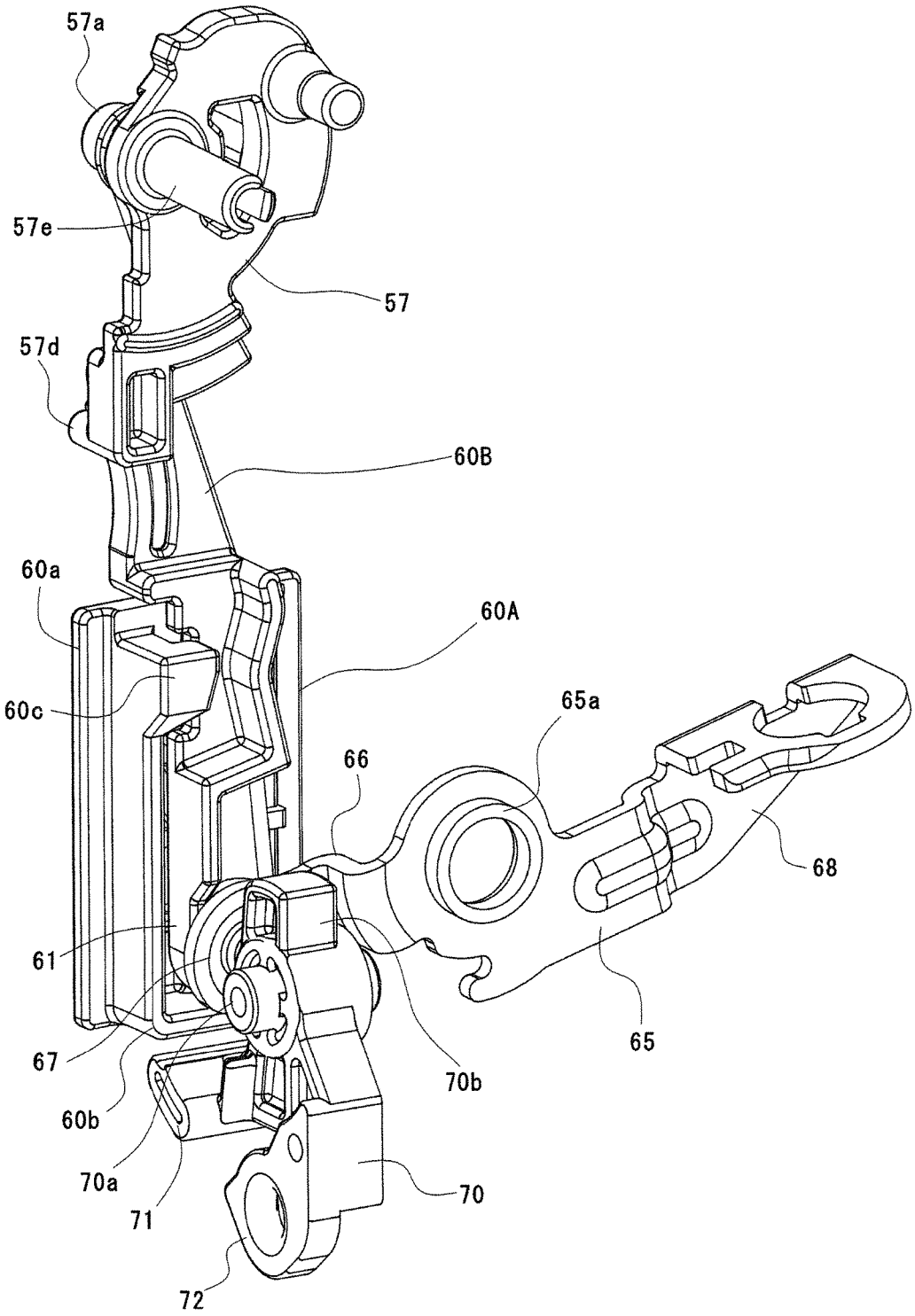
FIG. 9 is a perspective view showing a first link, a second link, an inner open lever, an outer open lever, and a locking lever.
Figure 10:
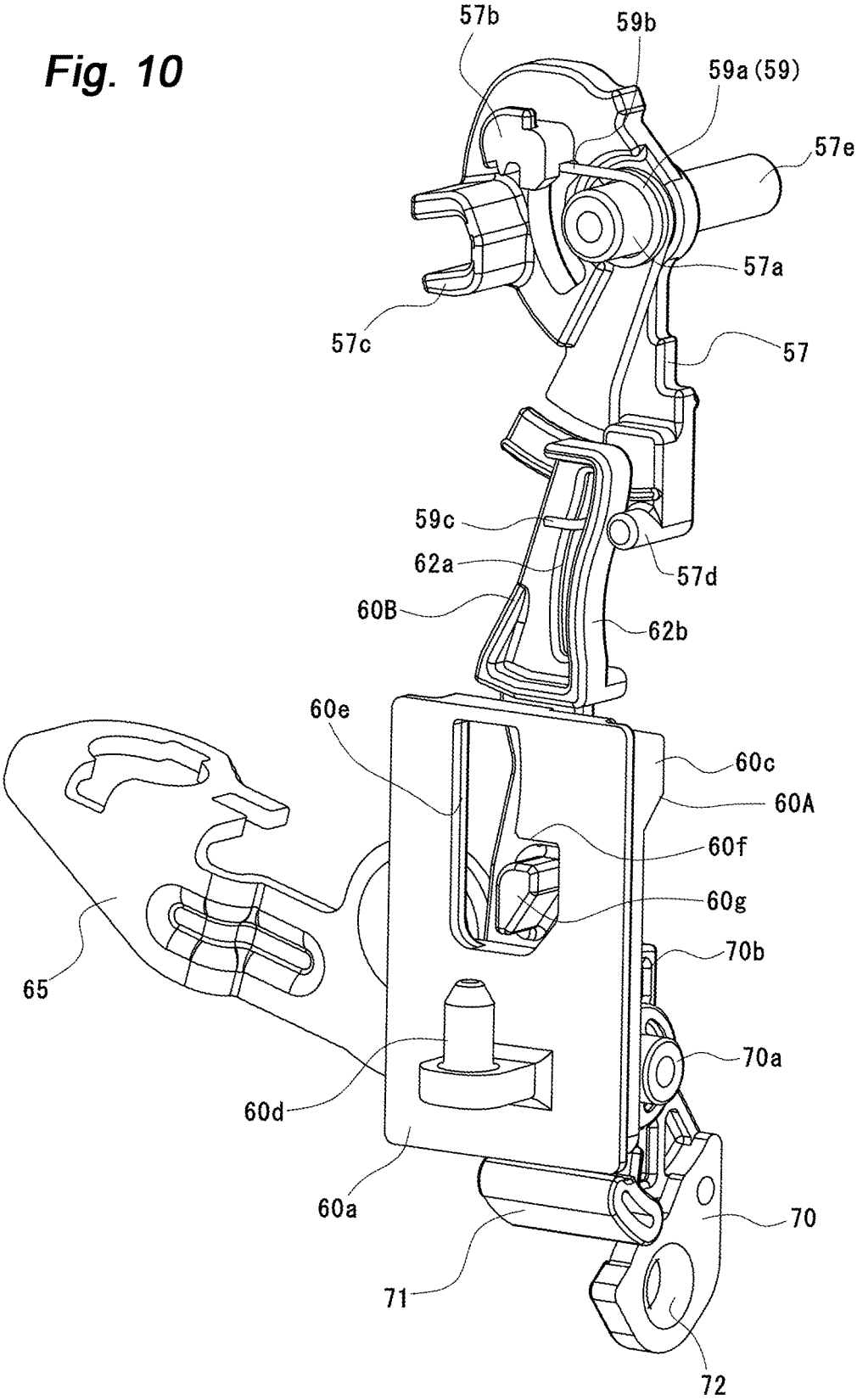
FIG. 10 is a perspective view of the first link, the second link, the inner open lever, the outer open lever, and the locking lever shown in FIG. 9 as viewed from a different angle.

As shown in FIG. 9 and FIG. 10, a side wall projects from one surface of a planar portion 60*a* of the first link 60A in the direction orthogonal to one surface of the planar portion 60*a*, wherein the side wall has an approximately L shape which extends from one short side portion of a side edge portion of the planar portion 60*a* to one long side portion of the side edge portion of the planar portion 60*a*. The side wall formed on the short side portion forms an operation receiving portion 60*b* which is pushed by a first link operating portion 71 of an inner open lever 70 described later. An upper end portion of a side wall formed on the long side portion further projects in the sideward direction thus forming an operating portion 60*c* which pushes the operation receiving portion 55 of the release lever 54.

A spring receiving portion 60*d* which projects in the upward direction along the other surface of the first link 60A is formed on a lower portion of the planar portion 60*a*. One end of the coil spring 63 is connected to the spring receiving portion 60*d*. The spring receiving portion 60*d* and the coil spring 63 are positioned in the spring housing portion 21*a* formed in the housing body 14, and the other end of the coil spring 63 is brought into pressure contact with an upper end surface of the spring housing portion 21*a*. Due to such a structure, the first link 60A is biased in the downward direction by the coil spring 63, and lower ends of both side portions of the first link 60A are moved to lower ends of both guide grooves 15*a* (one guide groove 15*a* not shown in the drawing).

An operation hole 60*e* is formed in the first link 60A in a penetrating manner such that the operation hole 60*e* opens on both surfaces of the first link 60A. The operation hole 60*e* is formed such that a lower half portion of the operation hole 60*e* is expanded in one direction compared to an upper half portion of the operation hole 60*e* thus forming a stepped portion 60*f*. A second link operating portion 60*g* of a second link 60B described later is brought into contact with the stepped portion 60*f* so that both links 60A, 60B can be moved together in the upward direction.

(1-3-4. Second Link)

The second link 60B is arranged in a gap which is formed with a predetermined size by the fence block 25 and the first link 60A in a state where the second link 60B is movable in the gap.

The second link 60B is arranged such that the second link 60B overlaps with the release lever 54 and the locking lever 57 along the direction of a rotary shaft (connecting shaft 57*e*) of the locking lever 57. An elongated hole 62*a* is formed in one end portion of the second link 60B in a penetrating manner such that the elongated hole 62*a* opens on both surfaces of the second link 60B. The other end 59*c* of the engaging spring 59 engages with the elongated hole 62*a* in a slidable manner. A guide surface 62*b* is formed on the second link 60B along the elongated hole 62*a*. The guide projecting portion 57*d* of the locking lever 57 can be brought into contact with the guide surface 62*b*.

A cylindrical connecting portion 61 is formed on the other end portion of the second link 60B, and a link connecting portion 67 which is a distal end portion of the second link operating portion 60*g* of the outer open lever 65 is connected to the cylindrical connecting portion 61. As described above, the second link 60B is arranged in the gap defined by the fence block 25 and the first link 60A. Accordingly, the movement of the second link 60B is restricted by the first link 60A and hence, the connection state between the cylindrical connecting portion 61 and the link connecting portion 67 can be maintained using the simple structure where the cylindrical connecting portion 61 of the second link 60B is merely inserted into the link connecting portion 67 of the outer open lever 65.

The second link operating portion 60*g* which is arranged in an operation hole 60*e* formed in the first link is formed on an intermediate portion of the second link 60B in a projecting manner in the thickness direction.

(1-4. Releasing Mechanism)

The releasing mechanism 64 includes the outer open lever 65 and the inner open lever 70, and is arranged on an inner surface side of the fence block 25.

(1-4-1. Outer Open Lever)

Figure 4:
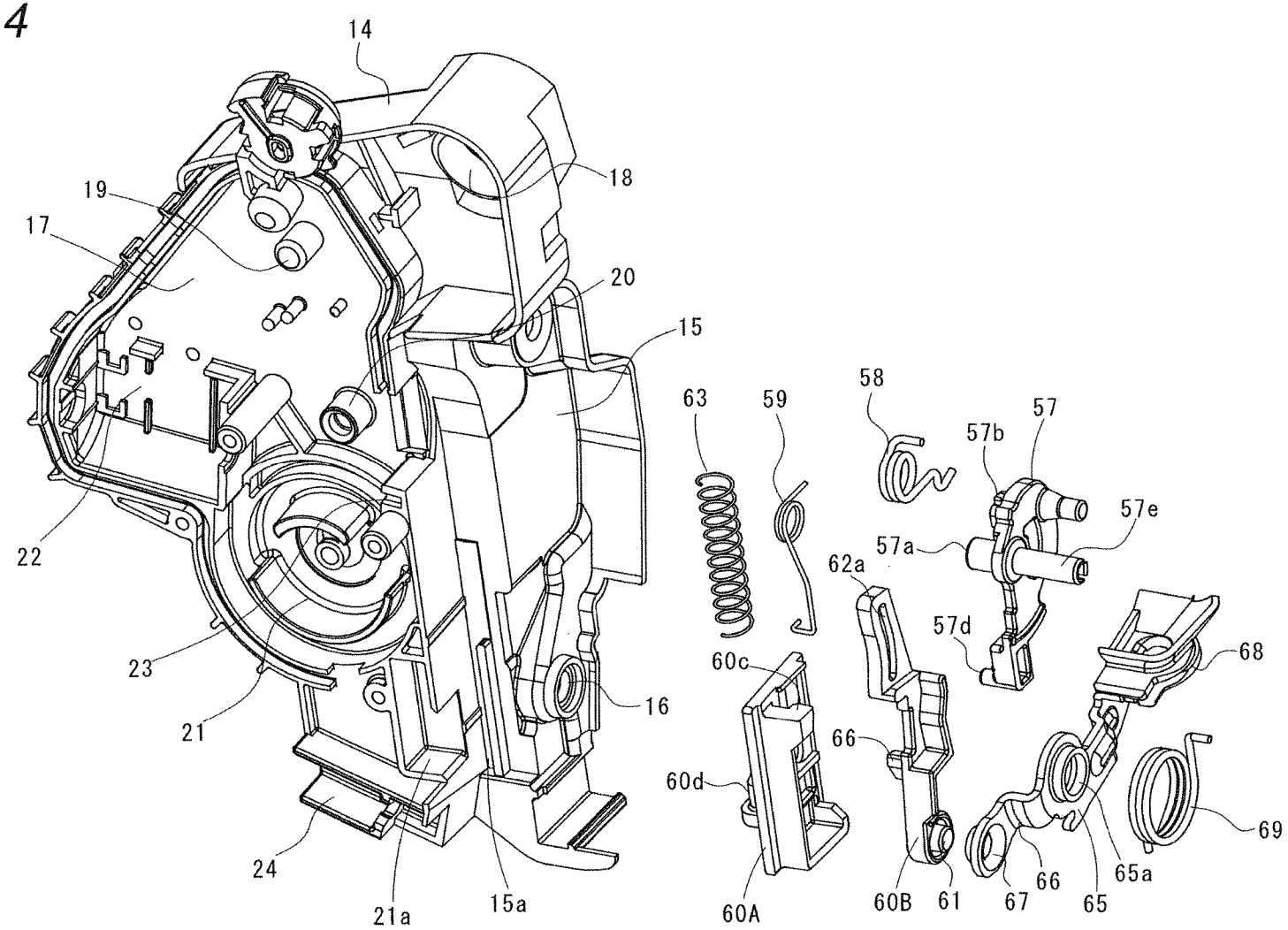
FIG. 4 is a partially enlarged view of FIG. 1.

As shown in FIG. 4 and FIG. 9, the outer open lever 65 is rotatably supported on the fence block 25 such that a bearing hole portion 65*a* of the outer open lever 65 is pivotally supported on the first pivotal support portion 33 (see FIG. 5) of the fence block 25. A second link operating portion 60*g* which projects toward a lower end of the second link 60B is formed on the outer open lever 65. A link connecting portion 67 inserted into the cylindrical connecting portion 61 of the second link 60B is formed on the second link operating portion 60*b* by burring. A first handle connecting portion 68 which projects toward the outside of the first housing portion 12 is formed on the outer open lever 65. A rod (not shown in the drawing) which is a connecting member connected to an outer door handle is connected to the first handle connecting portion 68. The outer open lever 65 is biased by the coil spring 69 such that the second link operating portion 60*g* is positioned at a lower side, and the second link 60B is moved downward (retracted) from an advancing position.

(1-4-2. Inner Open Lever)

As shown in FIG. 5 and FIG. 9, the inner open lever 70 is configured such that a shaft portion 70*a* of the inner open lever 70 is rotatably supported on the second pivotal support portion 34 of the fence block 25. A first link operating portion 71 which projects toward a lower end of the first link 60A is formed on the inner open lever 70. A second handle connecting portion 72 which projects outward from a lower end of the first housing portion 12 is formed on the inner open lever 70. A connection cable 2 (see FIG. 1) which is a connecting member connected to the inner door handle is connected to the second handle connecting portion 72. A projecting portion 70*b* which projects in the direction approximately opposite to the second handle connecting portion 72 with respect to the shaft portion 70*a* is formed on the inner open lever 70. The projecting portion 70*b* is brought into contact with the restricting wall 35*b* of the fence block 25 within an operation (rotation) range of the inner open lever 70. Accordingly, the removal of the inner open lever 70 from the second pivotal support portion 34 (bearing groove 35*a*) can be prevented. The inner open lever 70 is biased to a non-operation position by the coil spring 63 by way of the first link 60A.

In assembling the inner open lever 70 into the second pivotal support portion 34, the inner open lever 70 is inserted into the holding portion 35 of the second pivotal support portion 34 from a projecting portion 70*b* side, and the shaft portion 70*a* is inserted into the bearing groove 35*a*. Due to such an assembling operation, the shaft portion 70*a* is held by the holding portion 35 of the second pivotal support portion 34 so that the inner open lever 70 is rotatably supported.

In this manner, the inner open lever 70 is supported on the second pivotal support portion 34 of the fence block 25. Accordingly, the inner open lever 70 can be arranged in a space on a lower side of the latch mechanism 43 and on a latch mechanism 43 side (outside) with respect to a lower end of the first link 60A. Due to such a structure, the inner open lever 70 can be arranged on the fence block 25 without forming an extra space thus decreasing a thickness of the first housing portion 12.

(1-5. Switching Mechanism)

Figure 7:
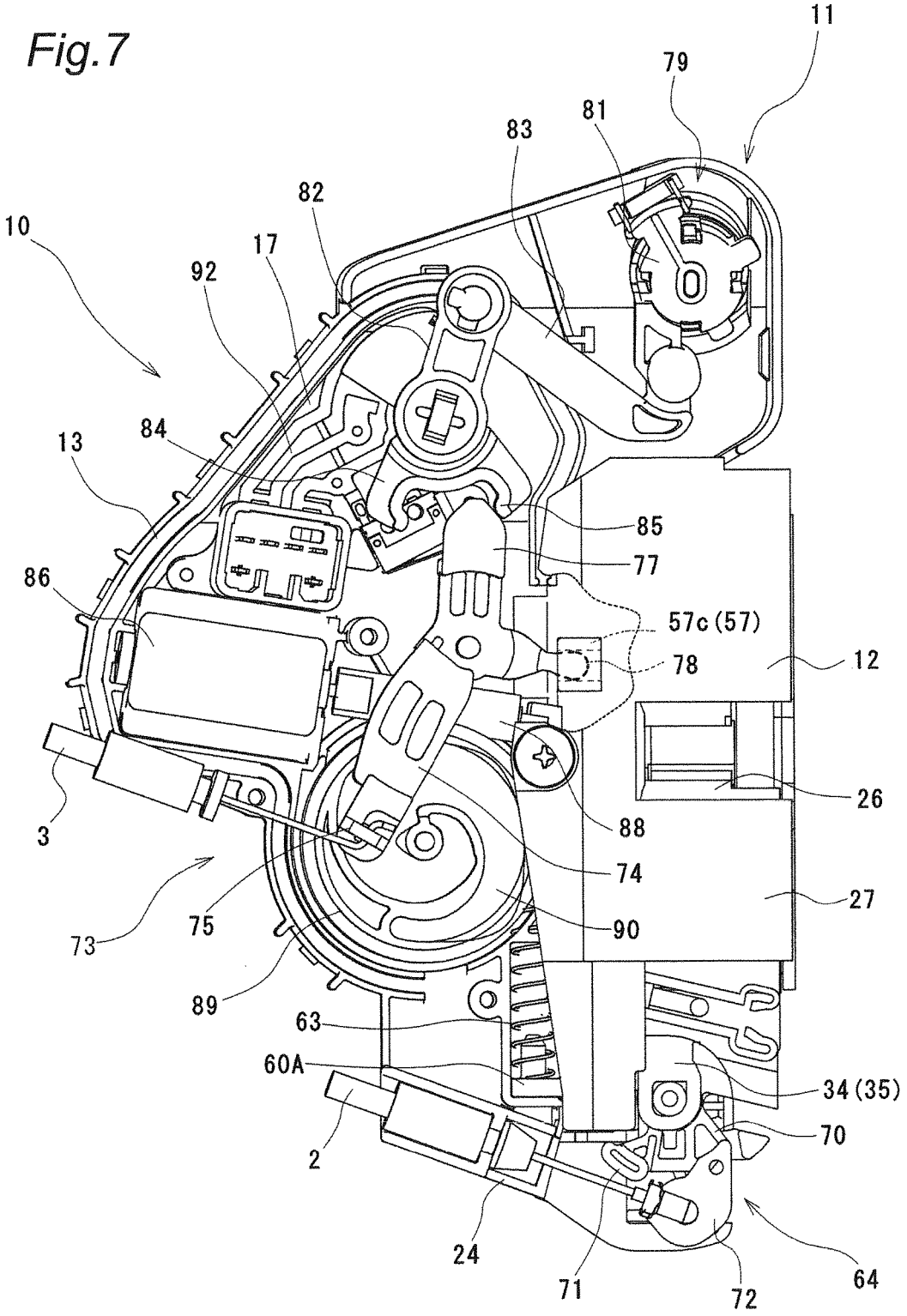
FIG. 7 is a front view of a second housing portion in an unlocked state in a state where a cover member is removed.
Figure 8:
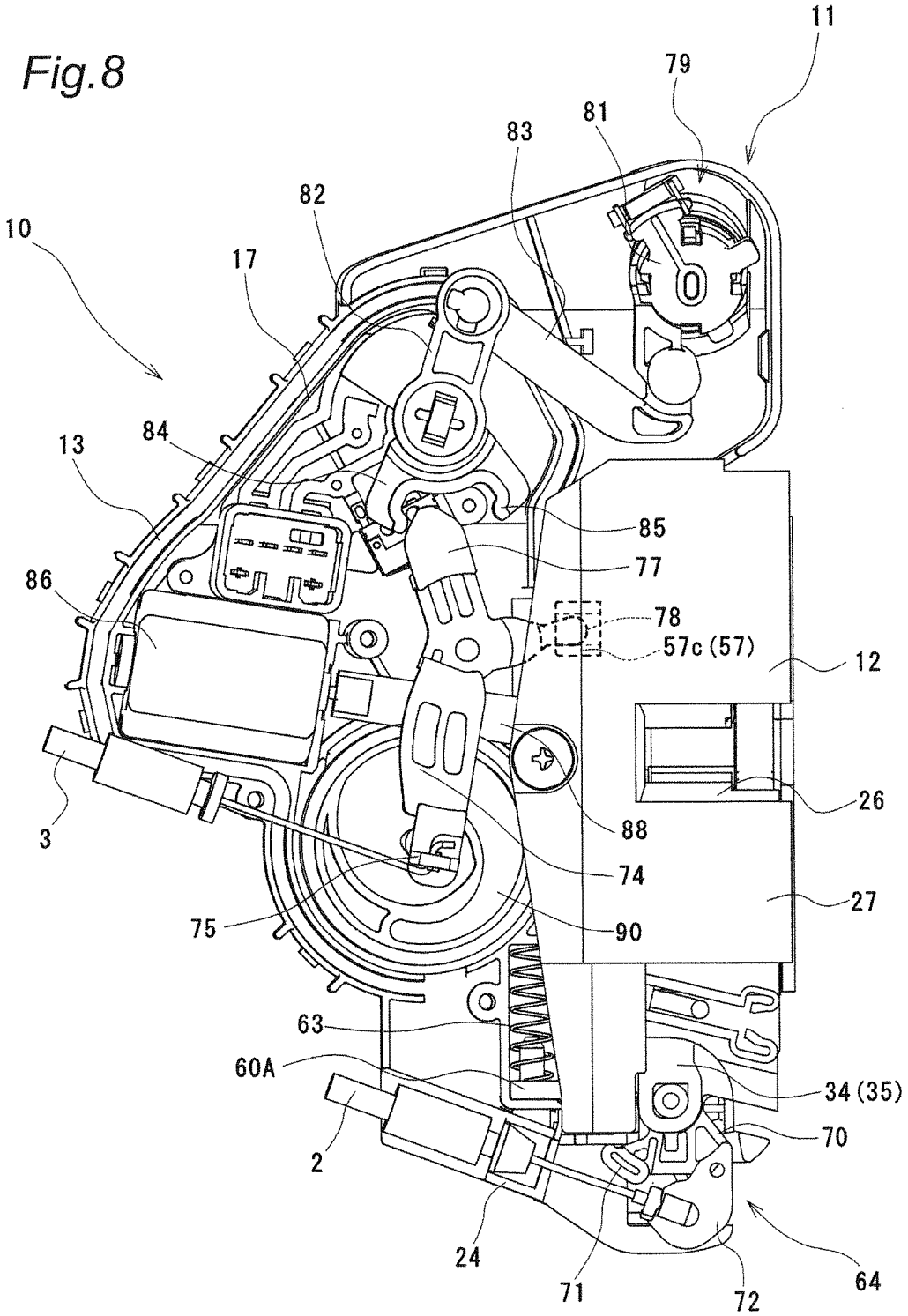
FIG. 8 is a front view of the second housing portion in a locked state in a state where the cover member is removed.

As shown in FIG. 1, FIG. 7 and FIG. 8, the switching mechanism 73 includes a manual operation system and an electrical operation system. The switching mechanism 73 is arranged on the second arrangement portion 17 of the housing body 14. The switching mechanism 73 changes over the second link 60B to a locked position by way of the locking lever 57 through a locking operation performed by either one of the operation systems, and the second link 60B is changed over to an unlocked position by way of the locking lever 57 through a lock releasing operation performed by either one of the operation systems.

The manual operation system includes: an inner locking unit which is operated by a locking knob (locking/locking-releasing operation portion) arranged on a vehicle inner side of a door; and an outer locking unit which is operated by a key cylinder (locking/locking-releasing operation portion) arranged on a vehicle outer side of the door. The inner locking unit includes a switching lever 74. The outer locking unit includes: a key rotor 79; a key link 83; a key inputting lever 82; and a key lever 84. The electrical operation system (electric locking unit) includes: a drive motor 86; a worm gear 88; and a wheel gear 89.

(1-5-1. Switching Lever)

The switching lever 74 is arranged at the switching lever supporting portion 20 of the second arrangement portion 17. A locking knob connecting portion 75 which extends toward the wheel gear 89 is formed on the switching lever 74 as a first manual operation receiving portion. A distal end of the locking knob connecting portion 75 is arranged in the inside of the communicating portion 42 of the cover member 39 (see FIG. 3), and the connection cable 3 connected to the locking knob is connected to the distal end of the locking knob connecting portion 75. A cam receiving portion 76 which projects toward the wheel gear 89 (see FIG. 2) is formed on the locking knob connecting portion 75 as an electrical operation receiving portion. A key operation receiving portion 77 which projects toward the key lever support shaft portion 19 and receives an operation of the key lever 84 is formed as a second manual operation receiving portion. A switching operation portion 78 which projects outward from an end surface of the second arrangement portion 17 and is connected to the connecting frame portion 57*c* of the locking lever 57 arranged in the inside of the first housing portion 12 is formed between the cam receiving portion 76 and the key operation receiving portion 77.

(1-5-2. Key Rotor)

The key rotor 79 is arranged in the key rotor arrangement hole 18 formed in the second arrangement portion 17 which is positioned outside the cover member 39. The key rotor 79 is constituted of a paddle connecting member 80 arranged in the key rotor arrangement hole 18 from a vehicle outer side of the door, and a key link connecting member 81 arranged in the key rotor arrangement hole 18 from a vehicle inner side (cover member 39 side) of the door.

The key inputting lever 82 is arranged at the key inputting lever arrangement portion 40 of the cover member 39.

The key link 83 connects the key link connecting member 81 and the key inputting lever 82 to each other.

The key lever 84 is arranged on the key lever support shaft portion 19 on an upper end (one end) side in the inside of the second housing portion 13. The key inputting lever 82 which is arranged outside the cover member 39 is integrally connected with the key lever 84 in a rotatable manner. The key lever 84 includes a fitting operation portion 85 positioned above the key operation receiving portion 77. The fitting operation portion 85 rotates the switching lever 74.

(1-5-3. Drive Motor)

The drive motor 86 is formed of an electric actuator, and is arranged at the motor arrangement portion 22 of the second arrangement portion 17 sideways. The output shaft 87 extends on the wheel gear arrangement portion 21 in the lateral direction, and a distal end of the output shaft 87 is held by the holding groove portion 23.

The worm gear 88 is mounted on the output shaft 87, and is arranged between the key lever 84 and the wheel gear 89 such that the worm gear 88 intersects with the switching lever 74.

The wheel gear 89 is a rotary member, and is arranged at the wheel gear arrangement portion 21 on a lower end (the other end) side in the inside of the second housing portion 13. A gear portion formed on an outer periphery of the wheel gear 89 is meshed with the worm gear 88 so that the wheel gear 89 is rotated in the normal rotation or in the reverse direction when the drive motor 86 is driven. On a surface of the wheel gear 89 on a switching lever 74 side, a cam portion 90 formed of a recessed groove having a predetermined shape is formed. The cam portion 90 is formed so as to move the cam receiving portion 76 inwardly and outwardly in the radial direction. The switching lever 74 is rotated by moving the cam receiving portion 76 in the radial direction by the cam portion 90.

The wheel gear 89 is held at a neutral position by a return spring 91 when the drive motor 86 is not operated. Symbol 92 indicates a printed circuit board having connectors for inputting and outputting signals and the like and for supplying drive electric power necessary for operating the electric locking unit.

(2. Manner of Operation)

Next, the manner of operation of the door locking device having the above-mentioned structure is explained.

(2-1. Door Locking Operation)

When a locking operation (key operation) is performed using the outer locking unit by inserting a normal key into a key cylinder, the key rotor 79 is rotated by way of a paddle which is a connecting member. Due to the rotation of the key rotor 79, the key inputting lever 82 and the key lever 84 which is integrally joined to the key inputting lever 82 are rotated by way of the key link 83. When the key lever 84 is rotated, the switching lever 74 is rotated in the counterclockwise direction in FIG. 7 by way of the fitting operation portion 85.

When a locking operation of the locking knob is performed using the inner locking unit (inner operation), as shown in FIG. 7 and FIG. 8, the switching lever 74 is rotated in the counterclockwise direction.

When lock driving of the drive motor 86 is performed using the electric locking unit by operating a remote controller or the like (remote control operation), the switching lever 74 is rotated in the counterclockwise direction by way of the worm gear 88 and the wheel gear 89.

Due to the rotation of the switching lever 74, the locking lever 57 to which the switching operation portion 78 of the switching lever 74 is connected is rotated about the locking lever support shaft portion 31. Due to the rotation of the locking lever 57, the edge portion of the second link 60B is pushed by the guide projecting portion 57*d* so that the second link 60B is rotated in the counterclockwise direction about the link connecting portion 67. That is, due to the locking mechanism 53, the second link 60B is rotated from an unlocked position shown in FIG. 11 to a locked position shown in FIG. 12 about the link connecting portion 67 so that the locking mechanism 53 is brought into a locked state.

In the locked state, the second link operating portion 60*g* of the second link 60B is separated from the stepped portion 60*f* of the operation hole 60*e* formed in the first link 60A. Accordingly, even when the second link 60B is moved in the upward direction by operating the outer door handle, the second link 60B is idled so that the first link 60A cannot be moved.

(2-2. Door Unlocking Operation)

An unlocking operation which is an operation opposite to the locking operation is performed by a key operation, an inner operation or a remote control operation.

Figure 11:
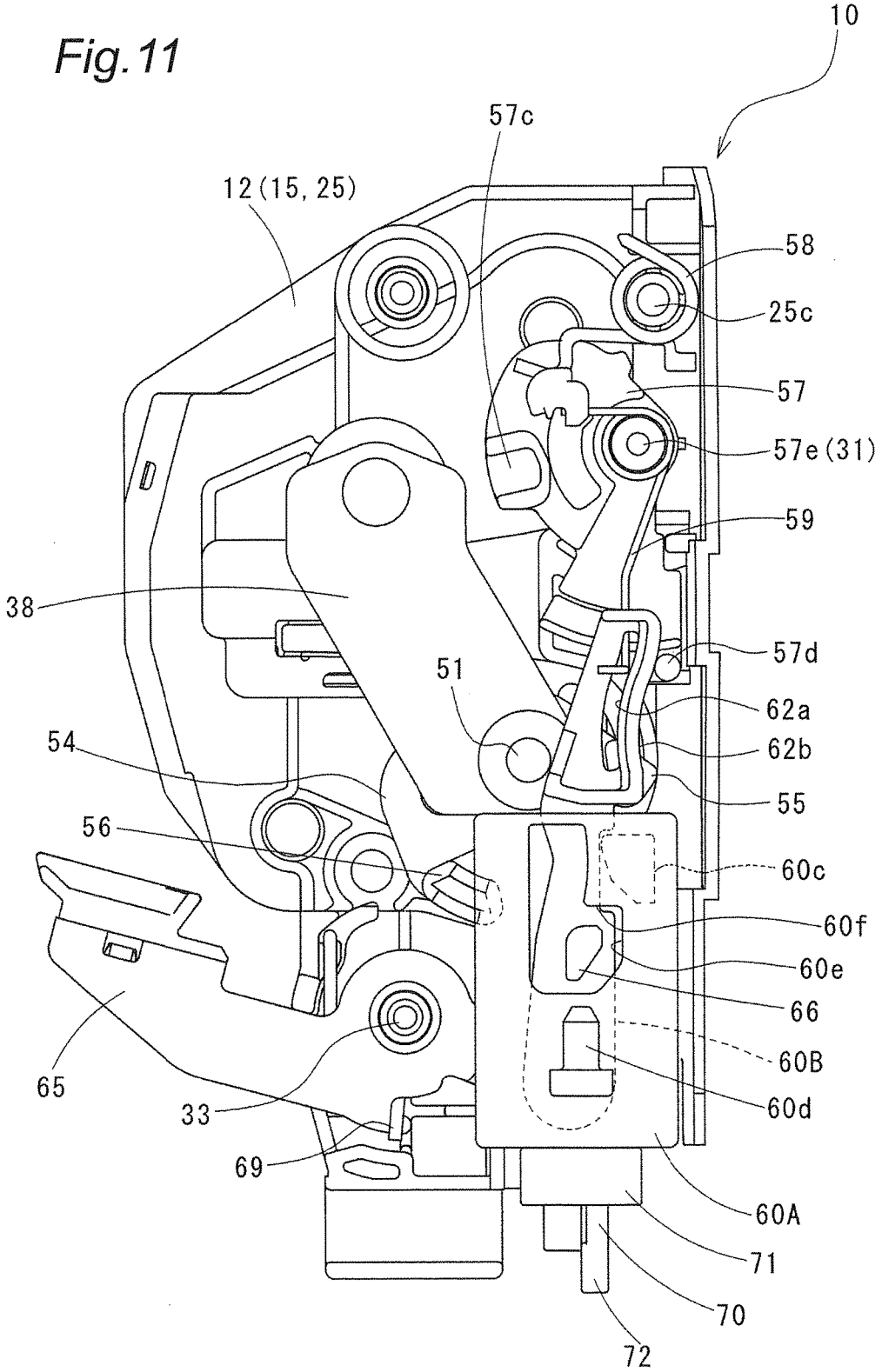
FIG. 11 is a front view showing a locking mechanism at an unlocked position and a releasing mechanism which are arranged in the first housing portion.

That is, the locking lever 57 is rotated to an unlocking operation position by way of the switching mechanism 73 (see FIG. 1) and, as shown in FIG. 11, the second link 60B is moved to an unlocked position where the second link 60B can operate the first link 60A. In the unlocked position, the stepped portion 60*f* of the operation hole 60*e* formed in the first link 60A can be pushed by the second link operating portion 60*g* of the second link 60B.

(2-3. Door Opening Operation)

When the outer door handle (not shown in the drawing) arranged on the door outside the vehicle is operated in a door closed state, the second link 60B is moved by way of the outer open lever 65. When the inner door handle arranged on the door inside the vehicle is operated, the first link 60A is moved by way of the inner open lever 70.

(2-3-1. Door Opening Operation in an Unlocked State)

When the outer door handle is operated in a state where the locking mechanism 53 is at an unlocked position, the outer open lever 65 is rotated in the counterclockwise direction about the first pivotal support portion 33 in FIG. 11 by way of a rod not shown in the drawing against a biasing force of the coil spring 69. Due to the rotation of the outer open lever 65, the second link 60B is moved in the upward direction so that the second link operating portion 60*g* of the second link 60B is brought into contact with the stepped portion 60*f* formed in the operation hole 60*e* of the first link 60A. As a result, both the first link 60A and the second link 60B are moved in the upward direction together. Then, due to the movement of the first link 60A in the upward direction, the operating portion 60*c* of the first link 60A pushes the operation receiving portion 55 of the release lever 54 so that the release lever 54 is rotated in the counterclockwise direction about the shaft member 51 in FIG. 11. Further, the claw lever 48 is also rotated from a state shown in FIG. 6 together with the release lever 54 so that the engagement of the claw lever 48 with the fork 44 is released whereby the fork 44 can be rotated to a release side. Due to the rotation of the fork 44, the striker 1 can be removed from the fork 44 so that the door is opened.

When the inner door handle not shown in the drawing is operated in a state where the locking mechanism 53 is at an unlocked position, the inner open lever 70 is rotated by way of a cable not shown in the drawing. Due to the rotation of the inner open lever 70, the first link 60A is moved in the upward direction by way of the first link operating portion 71 of the inner open lever 70 against a biasing force of the spring 63. When the first link 60A is moved in the upward direction, in the same manner as described above, the operating portion 60*c* of the first link 60A pushes the operation receiving portion 55 of the release lever 54 so that the claw lever 48 is also rotated together with the release lever 54 whereby the engagement of the claw lever 48 with the fork 44 is released. Due to the release of the engagement of the claw lever 48 with the fork 44, the striker 1 can be removed from the fork 44 so that the door is opened.

(2-3-2. Door Opening Operation in a Locked State)

Figure 12:
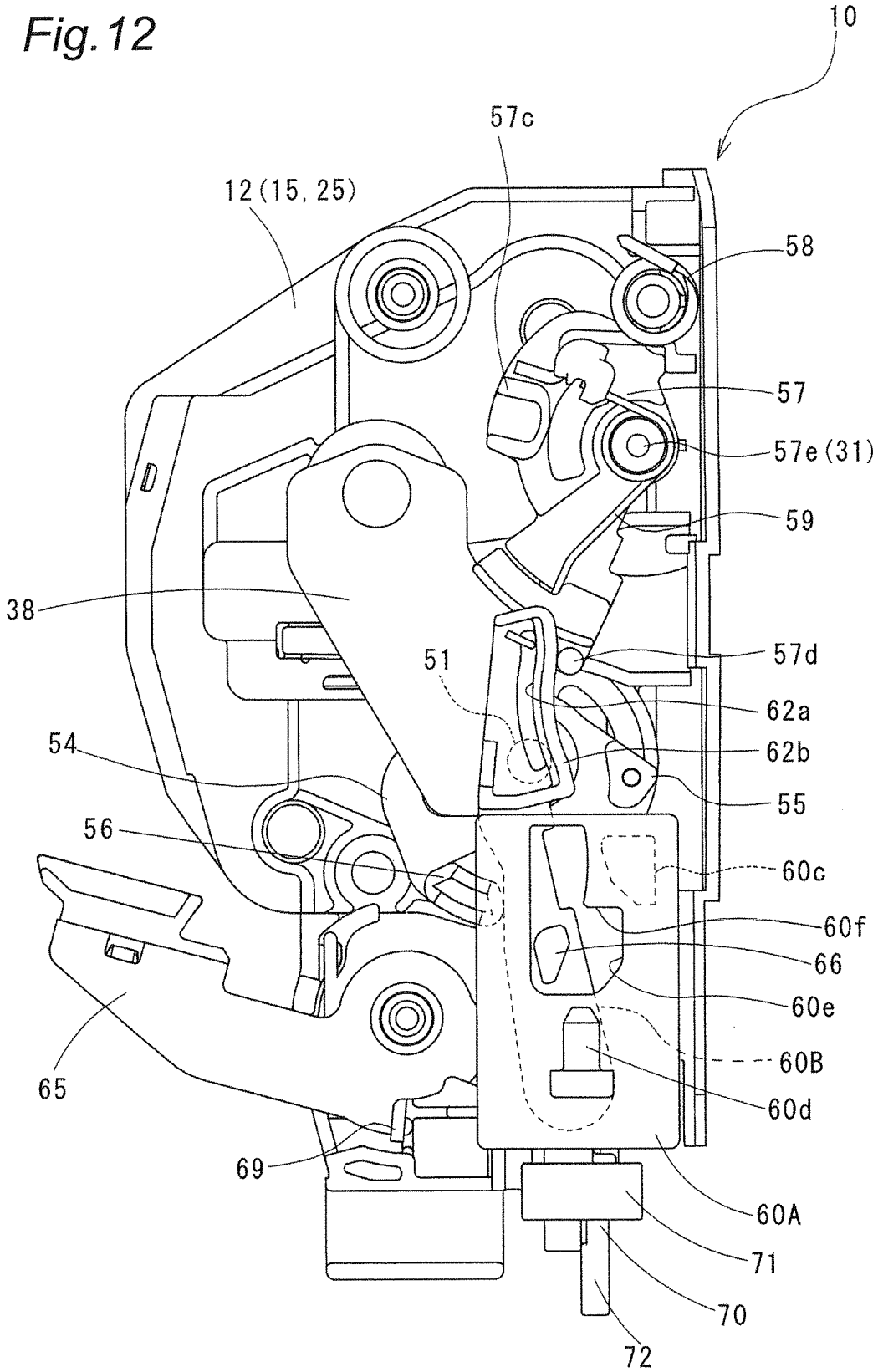
FIG. 12 is a front view showing the locking mechanism at a locked position and the releasing mechanism which are arranged in the first housing portion.

As described above, when the locking mechanism 53 is at a locked position, as shown in FIG. 12, the second link 60B is rotated to the locked position and hence, the second link operating portion 60*g* of the second link 60B is separated from the stepped portion 60*f* formed in the operation hole 60*e* of the first link 60A. Accordingly, even when the outer open lever 65 is rotated due to the operation of the outer door handle so that the second link 60B is moved in the upward direction, the second link operating portion 60*g* of the second link 60B is not brought into contact with the stepped portion 60*f* and is idled. Accordingly, the first link 60A is not moved, and the release lever 54 and the claw lever 48 maintain the current position. Accordingly, the engagement of the claw lever 48 with the fork 44 is maintained so that a state where the striker 1 is held by the fork 44 is maintained. That is, when the locking mechanism 53 is at the locked position, the door is not opened even when the outer door handle is operated.

Figure 13:
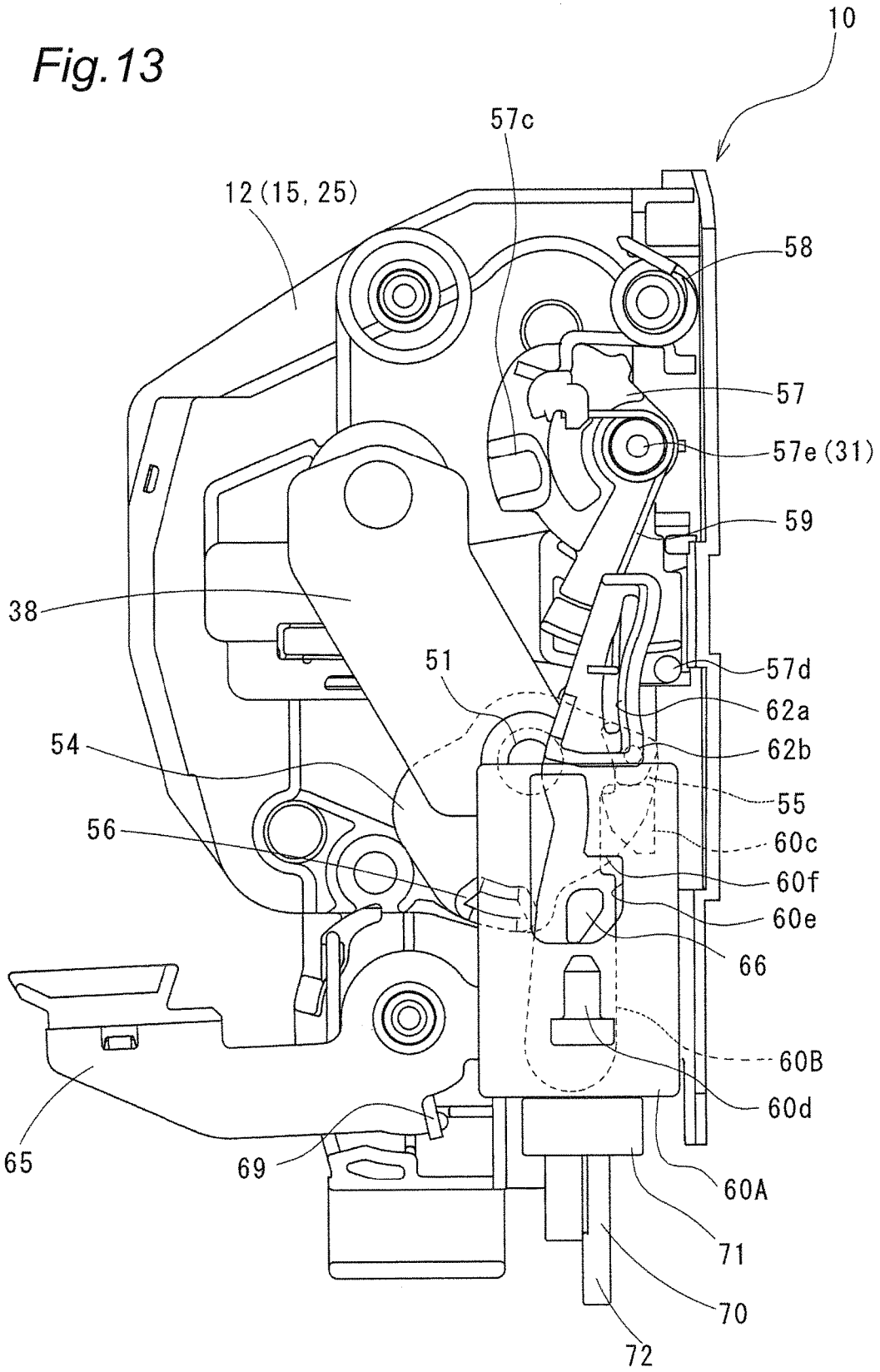
FIG. 13 is a front view showing a state where an inner door handle is operated from a state shown in FIG. 12.

On the other hand, when the inner door handle is operated in a state where the locking mechanism 53 is at a locked position, as shown in FIG. 13, the inner open lever 70 is rotated so that the first link operating portion 71 of the inner open lever 70 pushes the lower end portion of the first link 60A. Due to such pushing of the lower end portion of the first link 60A, the first link 60A is moved in the upward direction against a biasing force of the coil spring 63, and the operating portion 60*c* of the first link 60A pushes the operation receiving portion 55 of the release lever 54. Accordingly, in the same manner as the above, the release lever 54 is rotated together with the claw lever 48 so that the latch mechanism 43 is operated. That is, the claw lever 48 is removed from the fork 44. As a result, the striker 1 can be removed from the fork 44 so that the door is opened. In this manner, even when the locking mechanism 53 is at the locked position, the door locking device can exhibit a so-called override function where the door can be opened by operating the inner door handle.

In this case, when the release lever 54 is rotated due to the movement of the first link 60A in the upward direction, the cancellation operation portion 56 of the release lever 54 pushes the side edge portion of the second link 60B. Due to the pushing of the side edge portion of the second link 60B, the second link 60B is moved to the unlocked position from the locked position. Accordingly, when the inner door handle is operated, not only it is possible to open the door but also it is possible to move the second link 60B to the unlocked position thus releasing a locked state by the locking mechanism 53.

In this manner, to exhibit an override function, it is sufficient for the door locking device to operate only the first link 60A by the inner open lever 70. Accordingly, rotation range (stroke) of the inner door handle can be decreased by suppressing a moving range of the first link 60A and hence, the operability of the door locking device can be enhanced.

Whether the locking mechanism 53 is to be positioned in a locked state or in an unlocked state is determined by the positional relationship of the second link 60B with respect to the first link 60A. Accordingly, unlike the prior art, to realize the override function, it is unnecessary to change over the locking mechanism 53 to the unlocked state from the locked state by operating the inner door handle before the latch mechanism 43 is operated. That is, it is sufficient for the locking mechanism 53 and the latch mechanism 43 to have accuracy by which these mechanisms can exhibit their functions. Accordingly, the door locking device can be manufactured at a low cost.

Further, when the door locking device adopts the structure where the first link 60A is operated by the inner open lever 70 to which the connection cable 2 for transmitting an operation of the inner door handle is directly connected, the number of parts for transmitting an operating force of the inner door handle to the latch mechanism 43 can be decreased. Accordingly, a loss of a stroke caused by the connection of the respective parts can be decreased. Further, the inner open lever 70 operates only the first link 60A and hence, a required operation stroke can be shortened. Further, the first link 60A is not operated at a locked position and hence, a loss of a stroke caused by the connection of the first link 60A and the latch mechanism 43 can be decreased. As a result, the operation stroke of the inner door handle can be further shortened.

Further, when the first link 60A is operated due to the operation of the inner door handle, the release lever 54 is rotated simultaneously and the cancellation operation portion 56 of the release lever 54 can move the second link 60B to an unlocked position from a locked position. That is, both opening of the door and the release of a locked state of the door can be performed simultaneously by operating the inner door handle. Accordingly, a rotation range (stroke) of the inner door handle can be further decreased.

(2-4. Door Closing Operation)

When the door is closed in a state where the door is opened and the locking mechanism 53 is at an unlocked position, the striker 1 advances to a door side and pushes an inner edge constituting the engaging groove 45 of the fork 44. Due to such a pushing operation, the fork 44 is rotated to assume the engaging position shown in FIG. 6 against a biasing force of the spring 47. When the fork 44 is rotated to assume the engaging position, the engaging portion 49 of the claw lever 48 biased to the engaging position by the spring 52 engages with the engaging receiving portion 44*a* of the fork 44. As a result, a state where the striker 1 engages with the fork 44 is maintained so that the door is maintained in a closed state.

(2-5. Self Cancellation Operation)

When the door is closed in a state where the door is opened and the door locking device is erroneously brought into a locked state, a self cancellation operation which releases such a locked state is performed as follows.

That is, when the striker 1 of the vehicle body enters the engaging groove 45 of the fork 44 and rotates the fork 44 by pushing an inner edge of the engaging groove 45 of the fork 44, the claw lever 48 is temporarily rotated by being pushed by an outer edge of the fork 44. Due to the rotation of the claw lever 48, the release lever 54 which is rotated integrally with the claw lever 48 is also rotated. As a result, the cancellation operation portion 56 of the release lever 54 pushes a side edge portion of the second link 60B so that the second link 60B is moved to an unlocked position from a locked position (in the rightward direction) (A self cancellation operation which brings the locking mechanism 53 into an unlocked state is performed). In the manner, even when the door is erroneously closed in a state where the door is in a locked state, the cancellation operation portion 56 of the release lever 54 moves the second link 60B to an unlocked position and hence, it is possible to prevent the occurrence of a case where the opening of the door becomes impossible inadvertently while a key is left in the inside of a vehicle.

The door locking device 10 according to the present invention is not limited to the structure of the above-mentioned embodiment, and various modifications of the door locking device 10 are conceivable.

For example, the locking mechanism 53 in the above-described embodiment is configured such that the release lever 54 which is connected to the claw lever 48 and is rotated integrally with the claw lever 48 is provided, and the release lever 54 is operated by the first link 60A such that the claw lever 48 is rotated in the engaging releasing direction.

In place of such a structure, a cancellation operation portion 56 which penetrates the fence block 25 may be formed on the claw lever 48. The door locking device may not include the release lever 54. The release lever 54 and the claw lever 48 may be formed into an integral body, and the cancellation operation portion 56 may be formed on the integral body.

What is claimed is:

1. A door locking device comprising:

a latch mechanism with which a striker is engageable or from which the striker is disengageable;

a first link which operates the latch mechanism in an interlocking manner with an inner door handle so as to release the striker;

a second link which is movable between an unlocked position where the second link is operated in an interlocking manner with the first link and a locked position where the second link is not operated in an interlocking manner with the first link, and operates the latch mechanism in an interlocking manner with an outer handle by way of the first link in the unlocked position so as to release the striker;

a locking lever which changes over the second link between the unlocked position and the locked position;

a housing body which has two planar portions formed orthogonal to each other; and a cover member which covers one planar portion of the housing body;

wherein the first link is held in a reciprocally movable manner along groove portions formed on the housing body and the cover member respectively.

2. The door locking device according to claim 1, further comprising an inner open lever to which a connection member for transmitting an operation of the inner door handle is directly connected and which operates only the first link.

3. The door locking device according to claim 1, wherein the latch mechanism includes:

a release lever which is operated in an interlocking manner with the first link, the release lever including a cancellation operation portion which moves the second link to the unlocked position from the locked position due to the rotation of the release lever.

4. The door locking device according to claim 1, wherein the first link and the second link are arranged in an overlapping manner in the direction of a rotational axis of the locking lever.

5. The door locking device according to claim 1, further comprising a cancellation operation portion which moves the second link to the unlocked position from the locked position due to the rotation of a release lever.

6. A door locking device comprising:

a latch mechanism with which a striker is engageable or from which the striker is disengageable;

a first link which operates the latch mechanism in an interlocking manner with an inner door handle so as to release the striker;

a second link which is movable between an unlocked position where the second link is operated in an interlocking manner with the first link and a locked position where the second link is not operated in an interlocking manner with the first link, and operates the latch mechanism in an interlocking manner with an outer handle by way of the first link in the unlocked position so as to release the striker;

a locking lever which changes over the second link between the unlocked position and the locked position; and a release lever which is operated in an interlocking manner with the first link;

wherein the second link has an engaging portion, the first link has an operation hole in which the engaging portion is arranged, the operation hole has a region where the engaging portion is idled even when the second link is moved in a state where the second link is positioned at a locked position, and a stepped portion with which the engaging portion is brought into contact when the second link is moved in a state where the second link is positioned at an unlocked position, and the first link is provided with a lower end which is operated in an interlocking manner with the inner handle and an operating portion which operates the release lever.

* * * * *